US005448019A

United States Patent [19]

Berlovan, Jr.

[11] Patent Number: 5,448,019

[45] Date of Patent: Sep. 5, 1995

[54] WEIGHT OPTIMIZED END FITTING

[75] Inventor: Viorel Berlovan, Jr., North Royalton, Ohio

[73] Assignee: Hubbell Incorporated, Orange, Conn.

[21] Appl. No.: 172,201

[22] Filed: Dec. 23, 1993

Related U.S. Application Data

[63] Continuation-in-part of Ser. No. 102,911, Aug. 6, 1993.

[51] Int. Cl.[6] ..... H01B 17/08

[52] U.S. Cl. ..... 174/182; 174/141 R; 174/185; 174/186; 174/208

[58] Field of Search ..... 174/176, 191, 192, 194, 174/195, 141 R, 145, 150, 158 R, 160, 180, 182, 184–186, 188, 207, 208, 210

[56] References Cited

U.S. PATENT DOCUMENTS

| | | | |
|---|---|---|---|
| 1,248,498 | 12/1917 | Jackson et al. | 174/150 |
| 1,426,789 | 8/1922 | Steinberger | 174/184 |
| 1,796,428 | 3/1931 | Austin | 174/150 X |
| 3,272,463 | 9/1966 | Greig | 174/158 R X |
| 3,600,014 | 8/1971 | Harris | 174/176 X |
| 3,898,372 | 8/1975 | Kalb | 174/179 |
| 4,303,799 | 12/1981 | Ishihara et al. | 174/176 |
| 4,343,966 | 8/1982 | Pargamin | 174/140 S |
| 4,610,033 | 9/1986 | Fox, Jr. | 455/612 |
| 4,883,930 | 11/1989 | Martin | 174/182 |
| 4,972,291 | 11/1990 | Cunningham | 361/117 |
| 5,220,134 | 6/1993 | Novel et al. | 174/179 |

*Primary Examiner*—Leo P. Picard
*Assistant Examiner*—Paramita Ghosh
*Attorney, Agent, or Firm*—Jerry M. Presson; David L. Tarnoff

[57] ABSTRACT

An end fitting with optimized weight for supporting an end of a device, such as an insulator, placed under tension. The end fitting has a mounting sleeve for coupling the end fitting to a core member, a mounting hole for receiving a cylindrical mounting pin therethrough and a cutout or removed portion positioned between the mounting hole and the mounting sleeve for optimizing the weight of the end fitting. The mounting hole can optionally be provided with a pair of contacting points spaced laterally relative to the vector line of force to redirect the tensile load applied to the end fitting by a mounting pin located in the mounting hole. The end fitting is especially useful in insulators subjected to tensile loads.

20 Claims, 7 Drawing Sheets

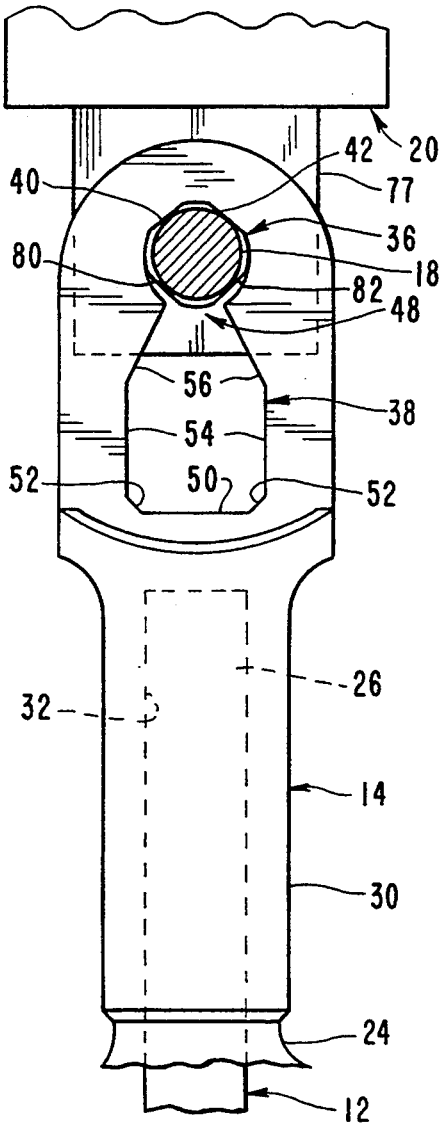
FIG. 4
FIG. 5
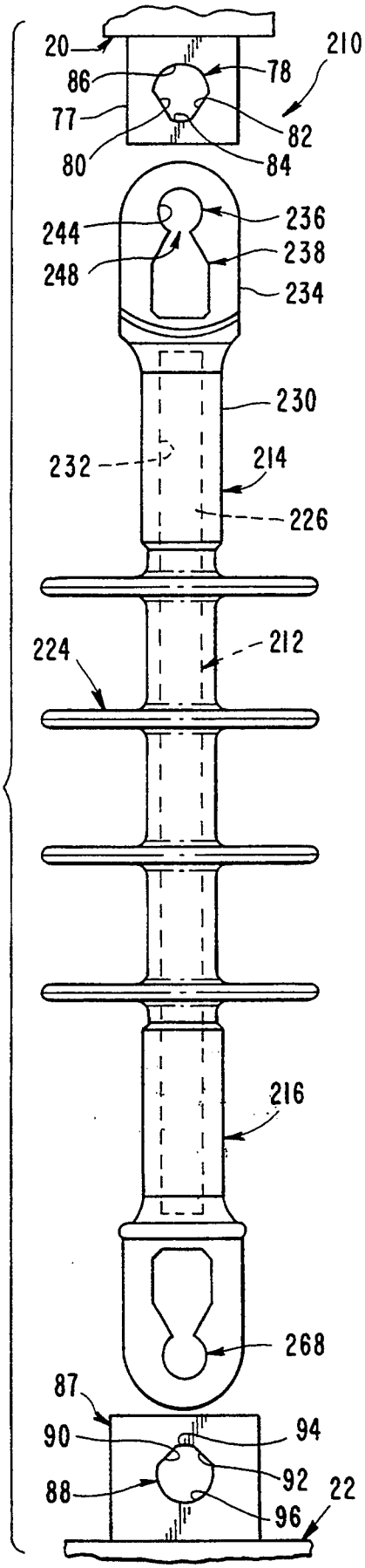

WEIGHT OPTIMIZED END FITTING

RELATED APPLICATION

This is a continuation-in-part of U.S. patent application Ser. No. 08/102,911 filed on Aug. 6, 1993 in the name of Viorel Berlovan, Jr. and entitled End Fitting with Optimized Stress Distribution, the entire disclosure of which is hereby incorporated herein by reference.

FIELD OF THE INVENTION

The present invention relates to an end fitting with optimized weight distribution for supporting an electrical device. More specifically, the area of the end fitting with minimal stress has been removed to reduce the weight and surface area of the end fitting to more uniformly distribute the stress within the end fitting. In other words, when the end fitting with the area of minimal stress removed is placed under tension, the stress within the end fitting is more evenly distributed than a conventional end fitting.

BACKGROUND OF THE INVENTION

Insulators are commonly employed for supporting high voltage electrical components and maintaining those components in a spaced relationship relative to other structures as well as the ground. Often such insulators are subjected to tensile stresses. For example, the insulator can be used as a hanger for supporting a transmission line with the insulator being suspended in tension between an arm of a tower and the transmission line. The insulator has a pair of end fittings for supporting and coupling the insulator to the support arm of the tower and to the transmission line.

As the voltage of the power transmission line increases, the length of the insulator supporting the transmission line must also be increased. Accordingly, insulators used with high voltage lines can be very long and heavy. This results in the end fittings being subjected to a large tensile stress or force, which requires the end fittings to be constructed as large, heavy duty members.

One example of an insulator is disclosed in U.S. Pat. No. 3,898,372 to Kalb. This insulator includes a central rod of insulating material, such as fiberglass. The ends of the rod include end fittings or coupling members for attaching the rod to transmission lines and to supporting structures. The central rod is surrounded by a series of weathersheds of a rubber-like polymeric material, for example, EPM. The weathersheds are placed end to end along the rod to form a long external surface path. A dielectric material fills spaces between the weathersheds and the insulator central rod to fill any voids between the rod and the weathersheds and to exclude contaminants and moisture which might otherwise form a conductive path.

Another example of an insulator is disclosed in U.S. Pat. No. 4,610,033 to Fox. This insulator has a pair of end fittings or coupling members for coupling the insulator between a support arm of a tower and a transmission line by a pair of shackles. The end fittings of this insulator are constructed of a metallic material.

Other examples of prior insulators with metallic end fittings are disclosed in U.S. Pat. No. 4,303,799 to Ishihara et al and U.S. Pat. No. 4,343,966 to Pargamin. The end fittings of these insulators have circular openings for coupling the insulators to supporting members.

In view of the above, it is apparent that a need exists for an insulator having end fittings or coupling members which optimize the amount of material required to produce an end fitting so as to reduce manufacturing costs. This invention addresses this need in the art along with other needs which will become apparent to those skilled in the art once given this disclosure.

SUMMARY OF THE INVENTION

Accordingly, an object of the present invention is to provide an insulator with at least one of its end fittings having its weight optimized by removing the area of minimal stress within the end fitting.

Another object of the invention is to provide an insulator having at least one end fitting with more evenly distributed stress.

A further object of the invention is to provide an insulator with at least one end fitting which is relatively inexpensive and simple to manufacture.

Another object of the invention is to provide an insulator with at least one of its end fittings having a hole with an optimized inner diameter for redirecting the axial force vector.

A further object of the invention is to provide an insulator with increased load strength without increased material.

The foregoing objects are basically attained by providing an insulator adapted to be coupled between a first supporting member and a second supporting member, comprising an elongated insulating member having a first end and a second end; a first end fitting coupled to the first end of the insulating member, and including a first mounting portion for coupling the first end fitting to the first end of the insulating member, and a first longitudinally extending flange coupled to the first mounting portion, the first flange having a first mounting hole sized to receive a first mounting pin therein, a first cutout portion located between the first mounting hole and the first mounting portion to reduce the weight of the first end fitting, and a portion of the material positioned between the first mounting hole and the first cutout portion to prevent movement of the first mounting pin from the first mounting hole into the first cutout portion; and a first end fitting coupled to the second end of the insulating member for coupling the second end fitting to the second support member.

The foregoing objects are also basically attained by providing an end fitting adapted to be coupled between a core member and a supporting member, comprising; a first mounting portion for coupling the core member of the electrical assembly thereto; and a first longitudinally extending flange coupled to the first mounting portion, the first flange having a first mounting hole sized to receive a first mounting pin therein, a first cutout portion located between the first mounting hole and the first mounting portion to reduce the weight of the first end fitting, and a portion of material positioned between the first mounting hole and the first cutout portion to prevent movement of the first mounting pin from the first mounting hole into the first cutout portion.

Other objects, advantages and salient features of the invention will become apparent from the following detailed description, which, taken in conjunction with the annexed drawings, discloses two preferred embodiments of the invention.

BRIEF DESCRIPTION OF THE DRAWINGS

Referring to the drawings which form part of this original disclosure:

FIG. 4 is an enlarged, partial side elevational view of the end fitting of the insulator illustrated in FIGS. 1–3 coupled to one of the supporting members;

FIG. 5 is a partial side elevational view of an end fitting for an insulator in accordance with a second embodiment of the present invention;

DETAILED DESCRIPTION OF THE INVENTION

Figure 1:
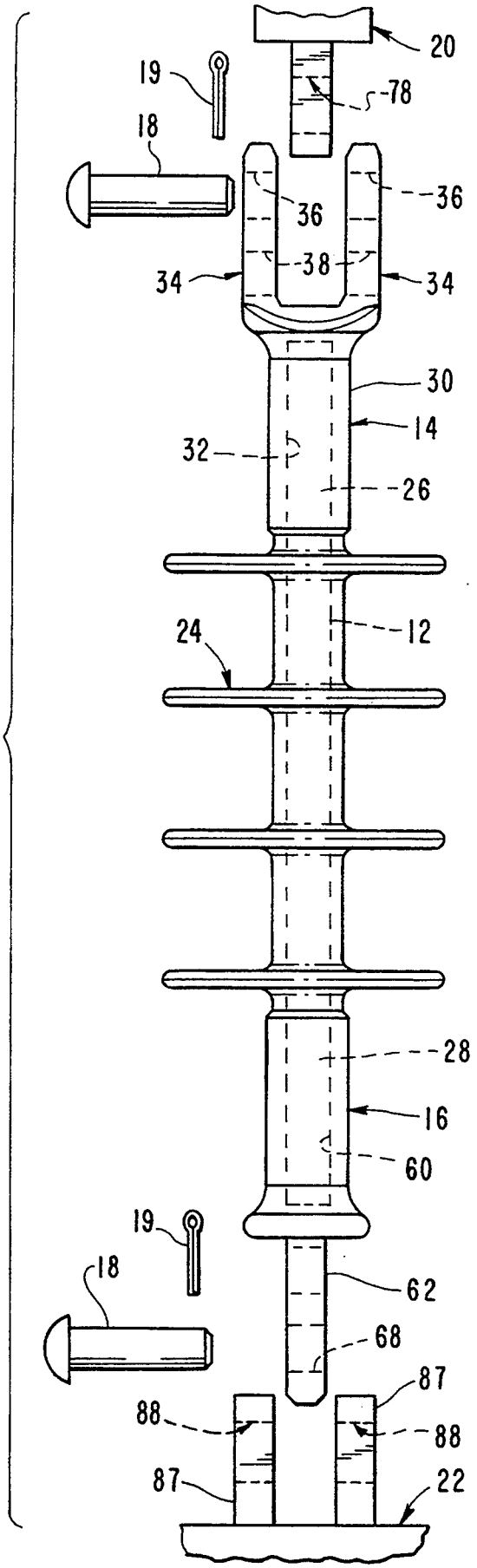
FIG. 1 is an exploded front elevational view of an insulator with a pair of end fittings and a pair of supporting or coupling members in accordance with the present invention.
Figure 2:
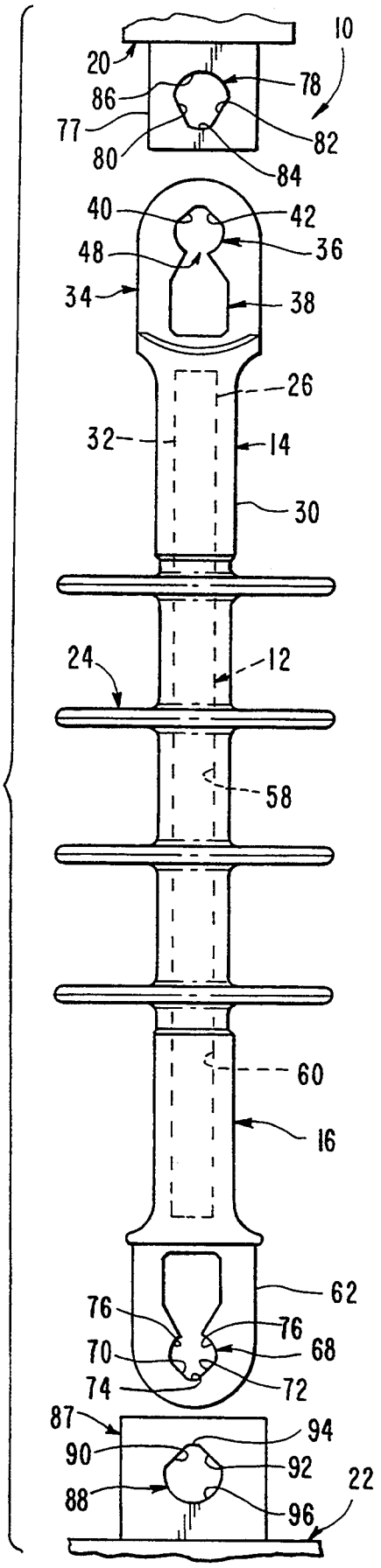
FIG. 2 is an exploded side elevational view of the insulator and supporting members of FIG. 1.

Referring initially to FIGS. 1 and 2, an electrical assembly 10 according to a first embodiment of the present invention is illustrated in the form of an insulator. Insulator 10 includes an insulating core member 12, a first end fitting or coupling member 14 rigidly coupled to the upper end of core member 12, a second end fitting or coupling member 16 rigidly coupled to the lower end of core member 12, a pair of metallic mounting pins 18 with cotter pins 19 for releasably coupling end fittings 14 and 16 to a pair of supporting members 20 and 22, and an elastomeric weathershed housing 24 overlying and enclosing the portion of core member 12 extending between end fittings 14 and 16.

Figure 3:
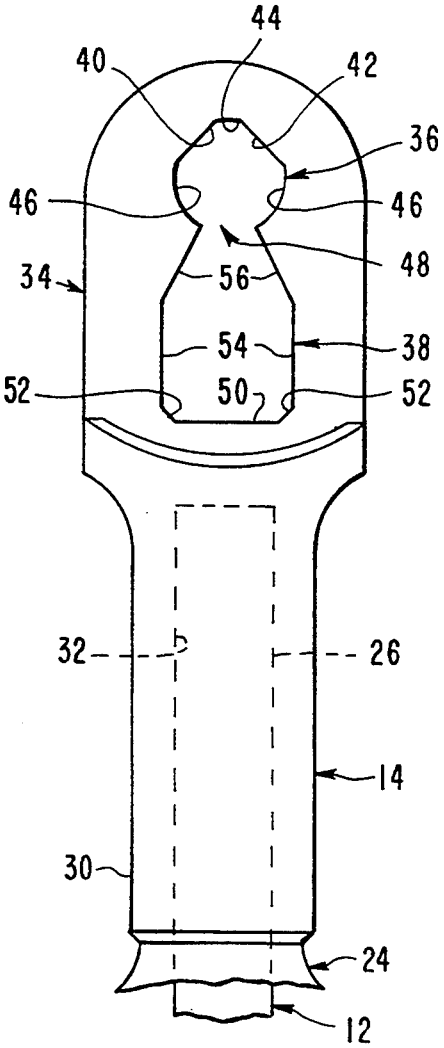
FIG. 3 is an enlarged, partial side elevational view of the upper end of the insulator illustrated in FIGS. 1 and 2 with the lower portion of the insulator broken away.

Core member 12 is illustrated as an elongated cylindrical insulating rod, which is preferably composed of fiberglass reinforced epoxy, vinylester or polyester resin. Core member 12 can also be formed from other electrical components such as resisters, arresters, capacitors, or any combination thereof. As seen in FIG. 3, core member 12 has a substantial uniform outer diameter with its upper and lower ends 26 and 28 fixedly coupled to end fittings 14 and 16 in a conventional manner, such as by crimping.

End fittings 14 and 16 are preferably metallic end fittings constructed of aluminum or forged steel such as AISI steel 1018 or any other suitable material. End fittings 14 and 16 are preferably connected to core member 12 in substantially the same manner, e.g., by crimping.

As seen in FIG. 3, end fitting 14 has an axially extending collar or sleeve 30 with an axially extending bore 32 at one end and a pair of longitudinally extending mounting flanges 34 at the other end. Bore 32 is substantially cylindrical and sized for receiving upper end 26 of core member 12. Sleeve 30 is preferably crimped onto upper end 26 of core :member 12 for fixedly coupling end fitting 14 to core member 12.

Mounting flanges 34 are substantially identical and extend longitudinally from sleeve 30 of end fitting 14. Each mounting flange 34 has a mounting hole 36 for receiving one of the mounting pins 18 therein to releasably couple end fitting 14 to first supporting member 20, and a cutout or removed portion 38 position between sleeve 30 and mounting hole 36 to reduce the weight and surface area of end fitting 14. Mounting flanges 34 are spaced apart from each other for receiving a portion of supporting member 20 therein.

As seen in FIGS. 2 and 3, each of the mounting holes 36 has a pair of flat contacting surfaces 40 and 42 converging towards the longitudinal axis of insulator 10, a first curved surface 44 extending between the converging ends of contacting surfaces 40 and 42, and a pair of second curved surfaces 46 and 48 extending between the diverging ends of the contacting surfaces 40 and 42 and removed or cutout portion 38.

Contacting surfaces 40 and 42 form angles between about 20° and about 65° with the longitudinal axis A of insulator 10. Preferably, contacting surfaces 40 and 42 are each angled approximately 45° with the longitudinal axis of insulator 10. Contacting surfaces 40 and 42 form two laterally spaced contacting points for tangentially engaging mounting pin 18 and for redirecting the axial force F applied to end fitting 14 by pin 18 to the two laterally spaced contacting points of contacting surfaces 40 and 42. Accordingly, the vector line of force F applied along the longitudinal axis A of insulator 10 is redirected laterally within the end fitting 14 to the contacting points of contacting surfaces 40 and 42 for reducing the magnitude of the force within the end fitting 14 by providing a more evenly distribution of stress within end fitting 14.

Figure 8:
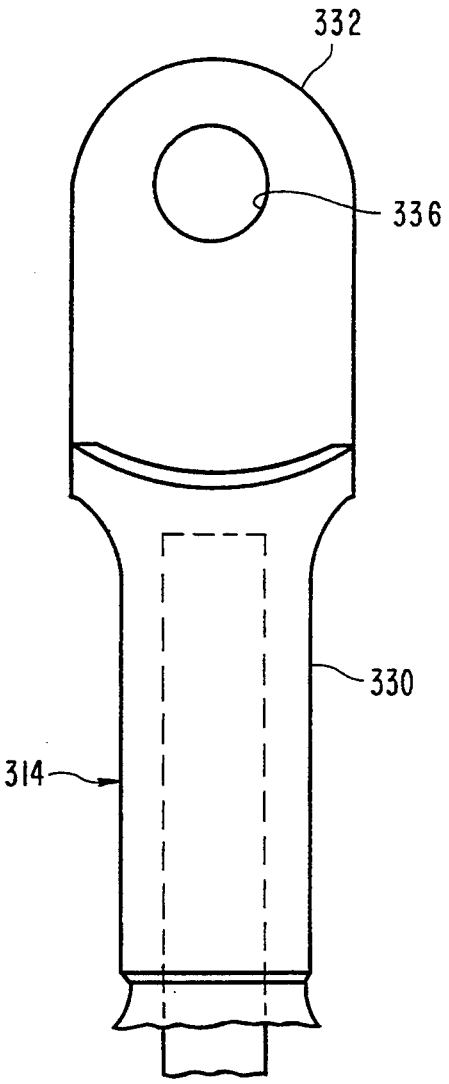
FIG. 8 (Prior Art)
FIG. 8 is a partial side elevational view of a prior art end fitting coupled to an insulator.
Figure 9:
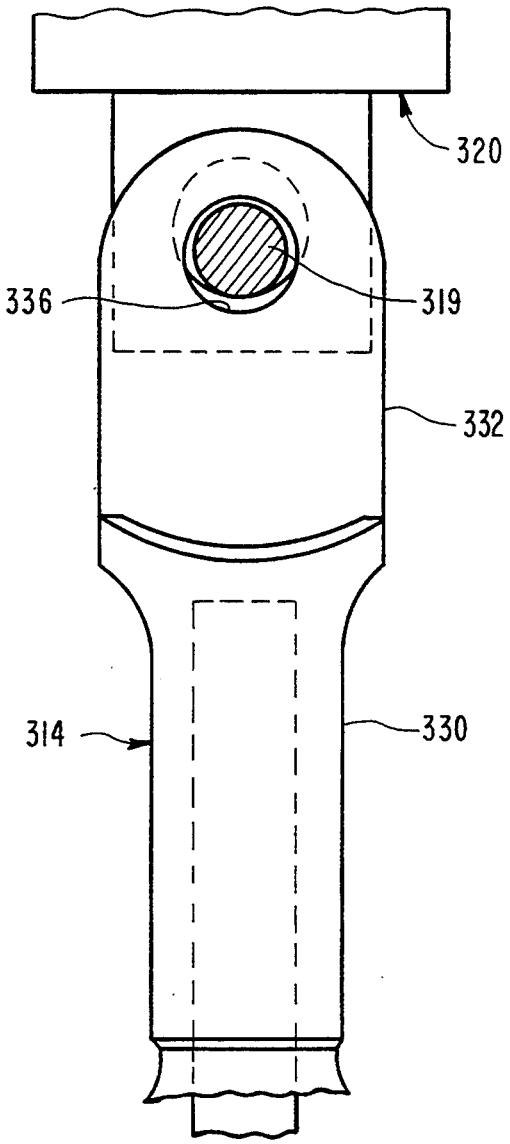
FIG. 9 (Prior Art)
FIG. 9 is an enlarged, partial side elevational view of a prior art end fitting illustrated in FIG. 8 coupled to a prior art supporting member.

In other words, contacting surfaces 40 and 42 tangentially engage mounting pin 18 at two points instead of one point as in the prior art end fitting 314 of FIGS. 8 and 9. Accordingly, mounting pin 18 does not engage first curved surface 44 at the point of the longitudinal axis of insulator 10. Since the amount of stress within end fitting is not concentrated at one point along the longitudinal axis of insulator 10, end fitting 14 can be made of less material, and still have the same or more strength than the prior art end fitting 314 with a circular opening 338 as shown in FIGS. 8 and 9.

First curved surface 44 and second curved surfaces 46 and 48 lie on a circle with a common center point with contacting surfaces 40 and 42 being secants of the circle. Preferably, first curved surface 44 forms an arc extending approximately 40°, while each of the second curved surface 46 forms an arc on the circle of about 120°.

Figure 10:
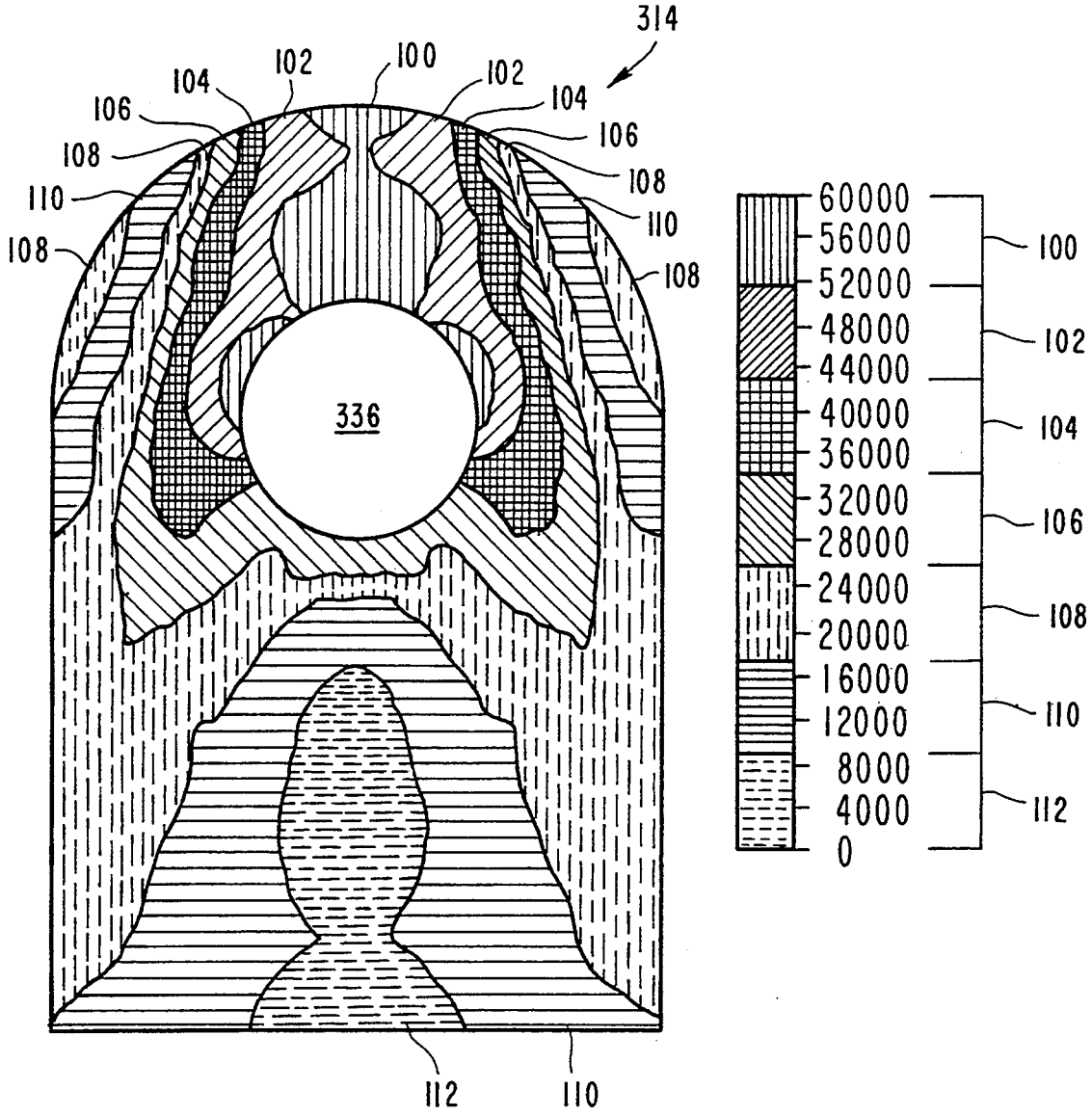
FIG. 10 is a computer printout of the stress distribution of a tensile load or stress applied to a prior art end fitting with a circular opening.

As seen in FIGS. 2–4, cutout or removed portion 38 of each of the mounting flanges 34 lies between sleeve 30 and mounting hole 36. The size and shape of cutout portion 38 was determined by loading and constraining a prior art end fitting, such as end fitting 314 illustrated in FIGS. 8 and 9, and then conducting a nonlinear Yon Mises analysis on the prior art end fitting to obtain a stress distribution plot, as seen in FIG. 10, for determining the low stress area to be removed so as to form cutout portion 38. Conventional end fitting 314 has a mounting sleeve 330 with a pair of mounting flanges 332 extending therefrom. The mounting flanges 332 each have a circular mounting hole 336 for receiving a mounting pin 319 for releasably coupling end fitting 314 to a conventional support member 320.

In other words, the cutout portion 38 of end fitting 14 is located in the area of low stress between sleeve 30 and mounting hole 36. Preferably, cutout portion 38 intersects with mounting hole 36 so as to reduce the weight and area of end fitting 14. The intersection of mounting hole 36 and cutout portion 38 forms a passageway 48 between mounting hole 36 and cutout portion 38. Passageway 48 has a width at least smaller than the diameter of the mounting pin 18 to prevent movement of the mounting pin 18 from the mounting hole 36 into the cutout portion 38. In other words, a portion of material of the end fitting 14 extends inwardly between mounting hole 36 and cutout portion 38 such that the space or passageway 48 between mounting hole 36 and cutout portion 38 is smaller than the diameter of the mounting pin 18 to prevent passage of the mounting pin 18 therebetween.

Cutout portion 38 is defined by a lower flat surface 50 extending substantially perpendicularly to the longitudinal axis of end fitting 14, a pair of diverging flat surfaces 52 extending outwardly from lower surface 50, a pair of flat parallel surfaces 54 extending from diverging surfaces 52 and substantially parallel to the longitudinal axis of end fitting 14, and a pair of converging flat surfaces 56 extending from parallel surfaces 54 to curved surface 44 of mounting hole 36.

Weathershed housing 24 has an axially extending bore 58 for receiving core member 12 therein. Specifically, bore 58 has a substantially uniform cylindrical inner diameter which is smaller than or equal to the diameter of core member 12 when in its unstressed state. The interface between bore 58 and core member 12 can be coated with a viscous insulating material, such as silicone grease to prevent the ingress of contaminants along the surfaces of core member 12 and bore 58 of weathershed housing 24.

Alternatively, bore 58 can have a series of annular grooves filled with a viscous insulating material as disclosed in U.S. Pat. No. 3,898,372 to Kalb, which is hereby incorporated herein by reference. Weathershed housing 24 is preferably composed of a polymeric, elastomeric material having sufficient resiliency to expand radially outwardly upon insertion of core member 12 into axially extending bore 58 of weathershed housing 24.

As seen in FIGS. 1 and 2, lower end fitting 16 has an axially extending bore 60 at one end for receiving a portion of core member 12 therein, and a mounting flange 62 at its other end for releasably coupling the lower end of insulator 10 to second supporting member 22 via one of the mounting pins 18. Bore 60 of lower end fitting 16 is substantially identical to bore 32 of upper end fitting 14, and thus will not be discussed or illustrated in detail.

As seen in FIG. 2, mounting flange 62 has a mounting hole 68 with a pair of flat contacting surfaces 70 and 72 converging towards the longitudinal axis of insulator 10, a first curved portion 74 extending between the converging ends of contacting surfaces 70 and 72, and a pair of second curved portion 76 extending between the diverging ends of contacting surfaces 70 and 72. Mounting hole 68 is substantially identical to mounting hole 36 and engages mounting pin 18 in substantially the same manner. Thus, mounting hole 68 will not be discussed or illustrated in detail herein.

First supporting member 20 is preferably coupled to a support arm of an electrical tower (not shown) in a conventional manner. Supporting member 20 has a mounting flange 77 with a mounting hole 78 for receiving mounting pin 18 therethrough for coupling the upper end of insulator 10 thereto.

As seen in FIG. 2, mounting hole 78 has a pair of flat contacting surfaces 80 and 82 converging towards the longitudinal axis of insulator 10, a first curved surface 84 extending between the first or close ends of contacting surfaces 80 and 82, and a second curved surface 86 extending between the second or diverging ends of contacting surfaces 80 and 82.

Contacting surfaces 80 and 82 are positioned to form angles ranging between about 20° and about 65° with the vector line of force applied to pin 18 when mounted in mounting hole 78. Preferably, contacting surfaces 80 and 82 are each angled approximately 45° with the longitudinal axis of insulator 10. Contacting surfaces 80 and 82 form two laterally spaced contacting points for tangentially engaging mounting pin 18 and for redirecting the axial force F applied to supporting member 20 by pin 18 to the two laterally spaced contacting points. Accordingly, the vector line of force F applied to insulator 10 and directed along the longitudinal axis A of insulator 10 is redirected laterally to the two contacting points for reducing the magnitude of the force distributed within the supporting member 20 by more evenly distributing the stress therein.

First curved surface 84 and second curved surface 86 lie on a circle with a common center point with contacting surfaces 80 and 82 being secant of the circle. Preferably, first curved surface 84 forms an arc extending approximately 40°, while second curved surface 46 forms an arc on the circle of about 220°.

Second supporting member 22 is preferably coupled to an electrical device or power line (not shown) in a conventional manner. Supporting member 22 has a pair of mounting flanges 87 spaced laterally apart for receiving mounting flange 62 of lower end fitting 16 therebetween. Mounting flanges 87 each have a mounting hole 88 therein for receiving one of the mounting pins 18 therethrough for connecting lower end fitting 16 thereto.

Mounting hole 88 has a pair of flat contacting surfaces 90 and 92 converging towards the longitudinal axis of insulator 10, a first curved surface 94 extending between the first or close ends of contacting surfaces 90 and 92, and a second curved surface 96 extending between the second or diverging ends of contacting surfaces 90 and 92.

Contacting surfaces 90 and 92 form angles ranging between about 20° and about 65° with the vector line of force applied to mounting pin 18 and transmitted thereto. Preferably, contacting surfaces 90 and 92 are each angled approximately 45° with the vector line of force applied to mounting pin 18 and transmitted thereto. Contacting surfaces 90 and 92 form two laterally spaced contacting points for tangentially engaging mounting pin 18 and for redirecting the axial force F applied to supporting member 22 by pin 18 to the two laterally spaced contacting points. Accordingly, the vector line of force which is applied to insulator 10 and transmitted to supporting member 22 along the longitudinal axis of insulator 10 is redirected laterally to the two contacting points for reducing the magnitude of the force distributed within supporting member 22 by more evenly distributing the stress therein.

First curved surface 94 and second curved surface 96 lie on a circle with a common center point with contacting surfaces 90 and 92 being secant of the circle. Preferably, first curved surface 94 forms an arc extending approximately 40°, while second curved surface 96 forms an arc on the circle of approximately 220°.

It will be apparent to those skilled in the art that insulator 10 can be used with a conventional supporting member with a circular mounting hole, and that end fittings 14 and 16 and coupling members 20 and 22 can be used with other devices or members which are subjected to a tensile force. For example, end fitting 14 and 16 could be used as end coupling members of a cable or chain.

Electrical Assembly or Insulator 210

Figure 6:
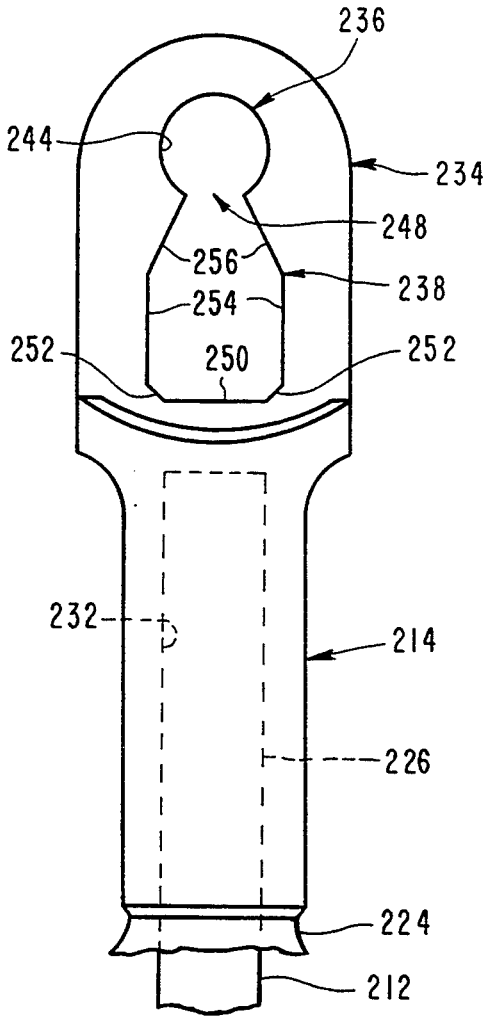
FIG. 6 is an enlarged, partial side elevational view of the upper end fitting of FIG. 5 with the lower portion of the insulator broken away.
Figure 7:
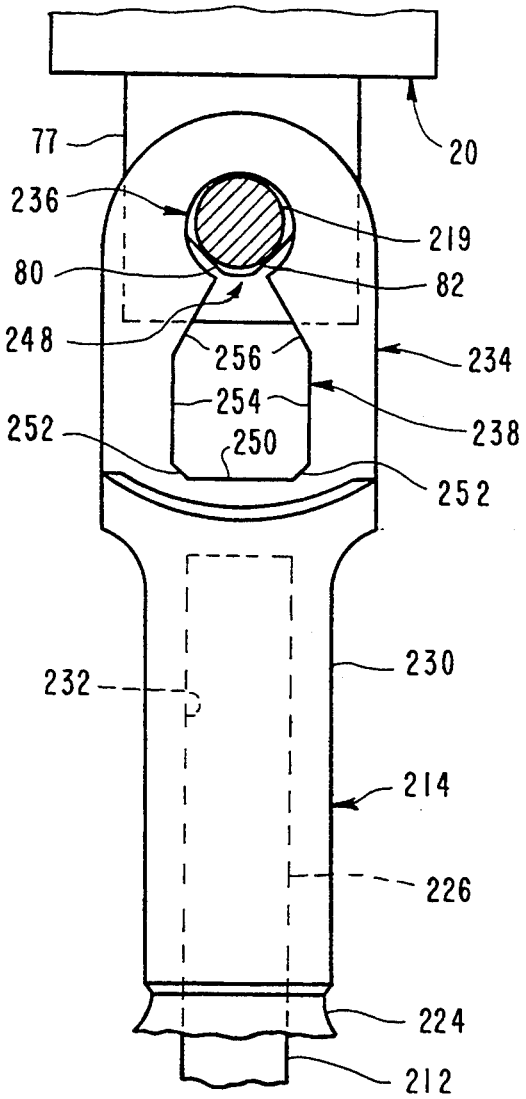
FIG. 7 is an enlarged partial side elevational view of the end fitting illustrated in FIGS. 5 and 6 coupled to a supporting member.

Referring now to FIGS. 5–7, an electrical assembly or insulator 210 with a pair of end fittings 214 and 216 is illustrated in accordance with a second embodiment of the present invention. End fittings 214 and 216 are substantially identical to end fittings 14 and 16, except that mounting holes 236 and 268 of end fittings 214 and 216 have been slightly modified from the mounting holes 36 and 68 of end fittings 14 and 16. Preferably, end fittings 214 and 216 are rigidly coupled to electrical assembly or insulator 210 which is substantially identical to electrical assembly or insulator 10 of the first embodiment. Accordingly, insulator 210 and end fittings 214 and 216 will not be discussed or illustrated in detail herein.

End fittings 214 and 216 are preferably constructed of aluminum or forged steel such as AISI steel 1018 or any other suitable material. End fittings 214 and 216 are connected to a core member 212 and a weathershed housing 224 in substantially the same manner as described above pertaining to the first embodiment. End fittings 214 and 216 are also releasably coupled to support members 20 and 22, respectively, in substantially the same manner as described above pertaining to the first embodiment. Thus, only end fitting 214 will be discussed and illustrated in detail herein.

End fitting 214 has an axially extending collar or sleeve 230 with an axially extending bore 232 at one end and a pair of longitudinally extending mounting flanges 234 at the other end (only one shown). Bore 232 is substantially cylindrical and sized for receiving the upper end 226 of core member 212. Sleeve 230 is preferably crimped onto the upper end 226 of core member 212 for fixedly coupling end fitting 214 to core member 212.

As seen in FIG. 7, mounting flanges 234 are substantially identical and extend longitudinally from sleeve 230 of end fitting 214. Each mounting flange 234 has a mounting hole 236 for receiving a mounting pin 219 therein to releasably couple end fitting 214 to a support member 20, and a cutout or removed portion 238 positioned between sleeve 230 and mounting hole 236 to reduce the weight and surface area of the end fitting 214. Mounting flanges 234 are spaced apart from each other for receiving a portion of supporting member 20 therebetween.

Each of the mounting holes 236 has a curved surface 244 for engaging the mounting pin 219. Curved surface 244 extends about 320° to prevent the movement of the mounting pin 219 from mounting hole 236 into cutout portion 238.

Cutout or removed portion 238 of each of the mounting flanges 234 lies between sleeve 230 and mounting hole 236. The size and shape of cutout portion 238 was determined by loading and constraining a prior art end fitting, such as end fitting 314 illustrated in FIGS. 8 and 9, and then conducting a nonlinear Von Mises analysis on the prior art end fitting to obtain a stress distribution plot for determining the low stress area to be removed to form cutout portion 238.

In other words, the cutout portion 238 of end fitting 214 is located in the area of low stress between sleeve 230 and mounting hole 236. Preferably, cutout portion 238 intersects with mounting hole 236 so as to reduce the weight and area of end fitting 214. The intersection of mounting hole 236 and cutout portion 238 forms a passageway 248 between mounting hole 236 and cutout portion 238. Passageway 248 has a width at least smaller than the diameter of the mounting pin to prevent movement of the mounting pin from the mounting hole 236 into the cutout portion 238. In other words, a portion of material of the end fitting 214 extends inwardly between mounting hole 236 and cutout portion 238 such that the space or passageway 248 between mounting hole 236 and cutout portion 238 is smaller than the diameter of the mounting pin 219 to prevent passage of the mounting pin 219 therebetween.

As seen in FIGS. 6 and 7, cutout portion 238 is defined by a lower flat surface 250 extending substantially perpendicularly to the longitudinal axis of end fitting 214, a pair of diverging flat surfaces 252 extending outwardly from lower surface 250, a pair of flat parallel surfaces 254 extending from diverging surfaces 252 and substantially parallel to the longitudinal axis of end fitting 214, and a pair of converging flat surfaces 256 extending from parallel surfaces 254 to curved surface 244 of mounting hole 236.

Figure 11:
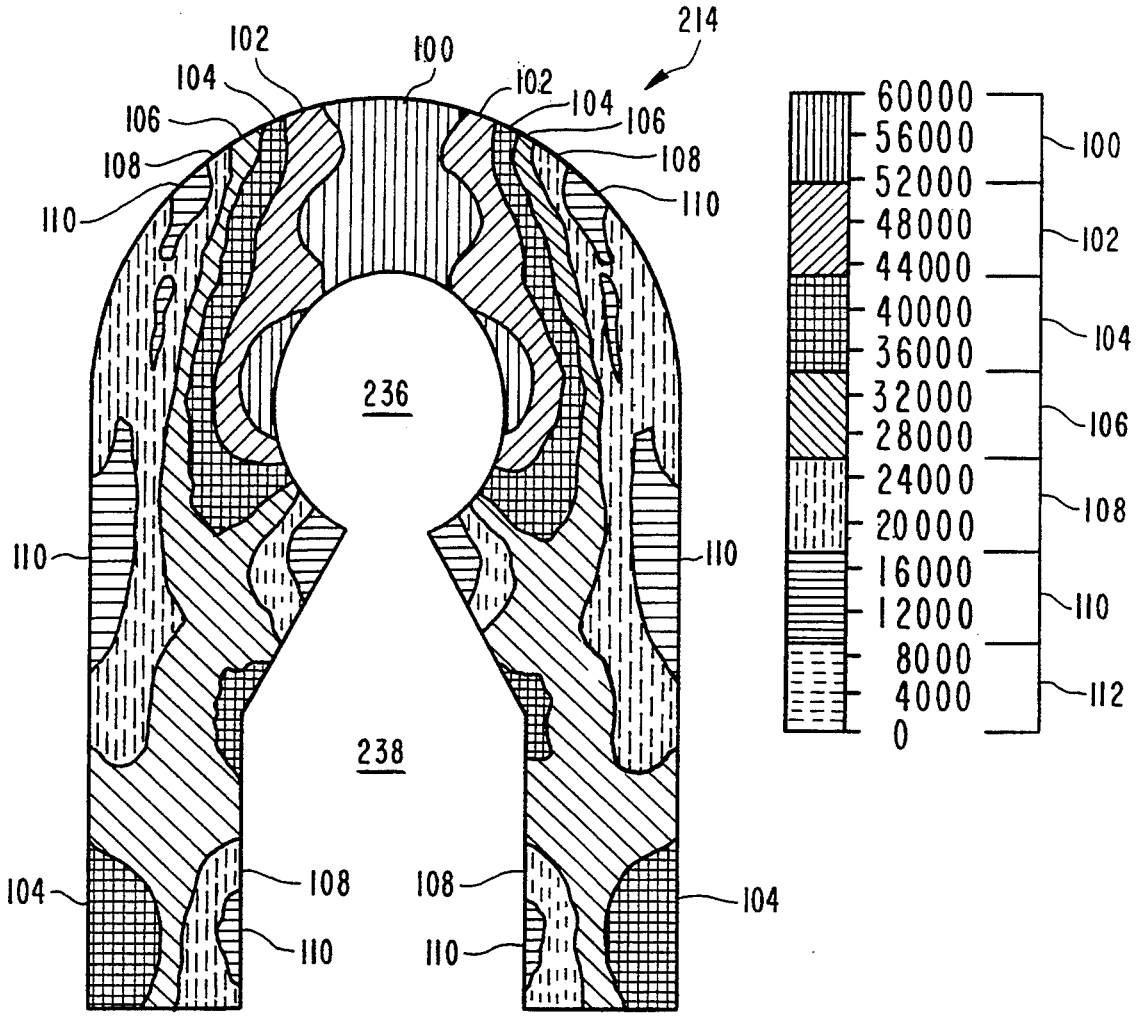
FIG. 11 is a computer printout of the stress distribution of a tensile load or stress applied to an end fitting constructed in accordance with the second embodiment of the present invention illustrated in FIGS. 5–7.

Referring now to the computer printouts of FIGS. 10 and 11, a nonlinear Von Mises analysis was used to obtain stress distribution plots of end fittings 314 and 214, respectively. In other words, the computer printouts of FIGS. 10 and 11 illustrate stress distribution within end fittings 314 and 214, respectively, which were equally loaded and constrained. In particular, a first test was conducted on a conventional end fitting such as end fitting 314 to determine the stress distribution in conventional end fitting 314. Then, an end fitting 214, in accordance with the present invention, was constructed with the portion of minimal stress, i.e., cutout portion 238, removed. A second test was conducted on end fitting 214 to determine the stress distribution therein.

The two computer printouts of FIGS. 10 and 11 illustrate the stress distribution within end fittings 314 and 214 according to seven levels or ranges of stress. The highest or first level of stress 100 ranges from 60,000 p.s.i. to 52,000 p.s.i. The next or second level of stress 102 ranges from 52,000 p.s.i. to 44,000 p.s.i. The third level of stress 104 ranges from 44,000 p.s.i. to 36,000 p.s.i. The fourth level of stress 106 ranges from 36,000 p.s.i to 28,000 p.s.i. The fifth level of stress 108 ranges from 28,000 p.s.i. to 20,000 p.s.i. The sixth level of stress 110 ranges from 20,000 p.s.i to 12,000 p.s.i. The seventh level of stress 112 ranges from 12,000 p.s.i to 0. The above stress were obtained by the Von Mises criteria.

Each of the end fittings were constructed of forged AISI 1018 steel. During the tests, a tensile force was applied to each of the end fittings 214 and 314. As seen in FIG. 10, the lowest stress areas 110 and 112 of end fitting 314 are located between mounting hole 336 and the end of the mounting flange 334. Moreover, the stress throughout end fitting 214 is more evenly and uniformly distributed than the stress in end fitting 314, since the lowest stress areas of end fitting 214 between mounting hole 236 and the mounting flange 234 has been removed.

While only two embodiments have been chosen to illustrate the invention, it will be understood by those skilled in the art that various changes and modifications can be made herein without departing from the scope of the invention as defined in the appended claims.

What is claimed is:

1. An electrical assembly adapted to be coupled between a first supporting member and a second supporting member, comprising:

an elongated core member having a first end and a second end with a longitudinal axis extending therebetween;

a first end fitting coupled to said first end of said core member, said first end fitting including a first mounting portion for coupling said first end fitting to said first end of said core member, and a first longitudinally extending flange coupled to said first mounting portion, said first flange having a first mounting hole extending transverse to said longitudinal axis and sized to receive a first mounting pin therein, a first cutout portion located between said first mounting hole and said first mounting portion to reduce the weight of said first end fitting, and a portion of material positioned between said first mounting hole and said first cutout portion to prevent movement of the first mounting pin from said first mounting hole into said first cutout portion, said portion of material between said first mounting hole and said first cutout portion forming a passageway therebetween which is smaller in width than said first mounting hole and said first cutout portion; and a second end fitting coupled to said second end of said core member for coupling said second end fitting to the second supporting member.

2. An electrical assembly according to claim 1, wherein said first cutout portion is sized to substantially remove all stress within said first end fitting below a predetermined level when said first end fitting is placed under a predetermined load.

3. An electrical assembly according to claim 1, wherein said first cutout portion is larger than said first mounting hole.

4. An electrical assembly according to claim 1, wherein said first mounting hole and said first cutout portion are contiguous.

5. An electrical assembly according to claim 1, wherein said mounting hole includes a curved surface extending along an arc greater than 180°.

6. An electrical assembly according to claim 1, wherein said first mounting hole includes first pair of pin contacting points formed by a pair of flat converging surfaces having first converging ends and second diverging ends.

7. An electrical assembly according to claim 6, wherein each of said converging surfaces form an angle with the vector line of force ranging from approximately 20° to approximately 65°.

8. An electrical assembly according to claim 6, wherein each of said converging surfaces form approximately a 45° angle with the vector line of force.

9. An electrical assembly according to claim 1, wherein said second end fitting includes a second mounting portion for coupling said second end fitting to said second end of said core member, and a second longitudinally extending flange coupled to said second mounting portion, said second flange having a second mounting hole sized to receive a second mounting pin therein, a second cutout portion located between said second mounting hole and said second mounting portion to reduce the weight of said second end fitting, and a portion of material positioned between said second mounting hole and said second cutout portion to prevent movement of the second mounting pin from said second mounting hole into said second cutout portion.

10. An electrical assembly according to claim 9, wherein said first mounting hole includes a first pair of pin contacting points formed by a first pair of flat converging surfaces, having first converging ends and second diverging ends, and said second mounting hole includes a second pair of pin contacting points formed by a second pair of flat converging surfaces having first converging ends and diverging second ends.

11. An electrical assembly according to claim 10, wherein each of said first and second pairs of converging surfaces form an angle with the vector line of force ranging from approximately 20° to approximately 65°.

12. An electrical assembly according to claim 10, wherein each of said first and second pairs of converging surfaces form approximately a 45° angle with the vector line of force.

13. An end fitting adapted to be coupled between a core member and a supporting member, comprising:

a first mounting portion for coupling to a first longitudinal end of the core member of an electrical assembly having a longitudinal axis; and a first longitudinally extending flange coupled to said first mounting portion, said first flange having a first mounting hole extending transverse to the longitudinal axis of the electrical assembly and sized to receive a first mounting pin therein, a first cutout portion located between said first mounting hole and said first mounting portion to reduce the weight of said end fitting, and a portion of material positioned between said first mounting hole and said first cutout portion to prevent movement of the first mounting pin from said first mounting hole into said first cutout portion, said portion of material between said first mounting hole and said first cutout portion forming a passageway therebetween which is smaller in width than said first mounting hole and said first cutout portion.

14. An electrical assembly according to claim 13, wherein a second longitudinally extending flange coupled to said first mounting portion, said second flange having a second mounting hole sized to receive the first mounting pin therein, a second cutout portion located between said second mounting hole and said second mounting portion to reduce the weight of said end fitting, and a portion of material positioned between said second mounting hole and said second cutout portion to prevent movement of the first mounting pin from said second mounting hole into said second cutout portion.

15. An electrical assembly according to claim 14, wherein said first mounting hole includes a first pair of pin contacting points formed by a first pair of flat converging surfaces, having first converging ends and second diverging ends, and said second mounting hole includes a second pair of pin contacting points formed by a second pair of flat converging surfaces having first converging ends and diverging second ends.

16. An electrical assembly according to claim 15, wherein each of said first and second pairs of converging surfaces form an angle with the vector line of force ranging from approximately 20° to approximately 65°.

17. An electrical assembly according to claim 15, wherein each of said first and second pairs of converging surfaces form approximately a 45° angle with the vector line of force.

18. An electrical assembly according to claim 13, wherein said first cutout portion is sized to substantially remove all stress within said end fitting below a predetermined level when said end fitting is placed under a predetermined load.

19. An electrical assembly according to claim 13, wherein said first cutout portion is larger than said first mounting hole.

20. An electrical assembly according to claim 13, wherein said first mounting hole and said first cutout portion are contiguous.

* * * * *